US006258496B1

(12) United States Patent
Makita et al.

(10) Patent No.: US 6,258,496 B1
(45) Date of Patent: Jul. 10, 2001

(54) STRETCHED MASK FOR COLOR PICTURE TUBE

(75) Inventors: Akira Makita; Yutaka Matsumoto, both of Tokyo; Taizo Sato; Yoshikazu Watanabe, both of Kudamatsu, all of (JP)

(73) Assignees: Toyo Kohan Co., Ltd.; Dai Nippon Printing Co., Ltd., both of Tokyo (JP)

( * ) Notice: Subject to any disclaimer, the term of this patent is extended or adjusted under 35 U.S.C. 154(b) by 0 days.

(21) Appl. No.: 09/245,706

(22) Filed: Feb. 8, 1999

(30) Foreign Application Priority Data

Feb. 6, 1998 (JP) ..... 10-025996

(51) Int. Cl.[7] ..... H01J 29/07

(52) U.S. Cl. ..... 430/23; 313/402; 313/407; 445/47

(58) Field of Search ..... 430/4, 23; 445/47; 313/402, 403, 407

(56) References Cited

U.S. PATENT DOCUMENTS

| | | | | |
|---|---|---|---|---|
| 5,532,088 | | 7/1996 | Teshima et al. | 430/4 |
| 5,709,804 | * | 1/1998 | Makita et al. | 216/12 |
| 6,117,253 | * | 9/2000 | Kim et al. | 148/603 |

FOREIGN PATENT DOCUMENTS

| | | |
|---|---|---|
| 0 567 989 | 3/1993 | (EP) . |
| 62-249339 | 10/1987 | (JP) . |

* cited by examiner

*Primary Examiner*—John A. McPherson
(74) *Attorney, Agent, or Firm*—Sughrue, Mion, Zinn, Macpeak & Seas, PLLC

(57) ABSTRACT

A stretched mask having a high tensile strength and favorable high-temperature creep properties and free from tape twist, and a material for the stretched mask. A low-carbon steel sheet containing 70 ppm to 170 ppm of nitrogen on a weight basis is heat-treated at a temperature at which recrystallization does not take place. The heat-treated material is provided with a resist pattern for forming apertures and subjected to etching to form apertures.

2 Claims, No Drawings

STRETCHED MASK FOR COLOR PICTURE TUBE

BACKGROUND OF THE INVENTION

The present invention relates to a stretched mask for a color picture tube, which can be used for any type of color picture tube, e.g. a shadow mask tube or an aperture grille tube, in color television and computer color displays.

In color picture tubes for color television and color displays, a mask for color selection is used so that electron beams are applied to predetermined phosphors. As the color selection mask, a shadow mask formed from a metal plate provided with a large number of small holes or an aperture grille provided with a large number of slits is used. When a color picture tube is used continuously for a long period of time, the shadow mask or the aperture grille is heated because accelerated electrons collide against it, and distorted by thermal expansion. This may cause the electron beams to be gradually displaced relative to the phosphor screen, resulting in color shift in the colored image.

In a color selection mask for a color picture tube, a stretched color discrimination mask like an aperture grille, which is stretched on a firm frame, is used together with a member pressed like a general shadow mask.

The stretched color discrimination mask is formed as follows. A hot-rolled low-carbon steel strip containing carbon in units of 0.0001% is cold-rolled to a sheet having a thickness of 0.02 mm to 0.30 mm. After a large number of grid elements have been formed in the cold-rolled steel strip by etching, the steel strip is welded to a frame placed under pressure applied in a direction reverse to the stretching direction. Then, the pressure is removed to form tension by the restoring force of the frame. Thereafter, to prevent the generation of secondary electrons, heat radiation, the formation of rust, etc., the mask material is subjected to heat treatment for 10 to 20 minutes in an oxidizing atmosphere at 450° C. to 470° C., thereby blackening the surface of the mask.

Conventionally, there is a likelihood that the tension of the grid elements of the color discrimination mask may reduce during the production, and this is a matter of great concern in quality control. The problem is due to the fact that the grid elements elongate by creep caused by heat and tension during the blackening of the color discrimination mask material. The grid elements having a low tension recovery factor and lowered tension because of large creep have the problem that if vibrations are applied to the grid elements, for example, when the sound level of a speaker provided in the same cabinet as that for the color picture tube, the grid elements themselves vibrate with large amplitudes, causing color shift in the colored image.

To solve the problem, JP2548133 (B2) discloses a color selection mechanism formed from a low-carbon steel sheet containing 40 ppm to 100 ppm of nitrogen. JP2683674 (B2) proposes a low-carbon steel sheet containing 0.20 to 5 2.0% by weight of Cr and 0.10 to 3.0% by weight of Mo. However, these low-carbon steel sheets have the problem that because of large residual stresses, the tape portion of the aperture grille is unfavorably twisted after the heat treatment.

JP799025 (A) (U.S. Pat. No. 5,552,662) discloses a method of producing an aperture grille using a material having small residual stresses. However, because the tensile strength is low, there is almost no change in the tension recovery factor. Therefore, the tape of the aperture grille may break when the aperture grille is stretched. If the aperture grille is stretched under a tension with which the tape will not break, the stretching tension reduces undesirably after the heat treatment.

An object of the present invention is to provide a stretched color selection device for a color picture tube that has minimal residual stresses and is free from problems such as twisting and that has a high tension recovery factor.

SUMMARY OF THE INVENTION

The present invention provides a stretched mask for a color picture tube, which is stretched on a frame. The stretched mask is formed from a low-carbon steel sheet containing 70 ppm to 170 ppm of nitrogen on a weight basis. The low-carbon steel sheet is heat-treated at a temperature at which recrystallization does not take place. Thereafter, the low-carbon steel sheet is provided with a resist pattern for forming apertures and subjected to etching to form apertures in the low-carbon steel sheet.

In addition, the present invention provides a stretched mask for a color picture tube, which is stretched on a frame. The stretched mask is formed from a low-carbon steel sheet containing 70 ppm to 170 ppm of nitrogen on a weight basis. The low-carbon steel sheet has a tension recovery factor of not less than 90% after being heat-treated at a temperature at which recrystallization does not take place. The tension recovery factor is expressed as the ratio of a recovered tension to an initial tension. The recovered tension is defined as follows. The length of a test piece when a load of 500 $N/mm^2$ is applied thereto at 25° C. is defined as an initial length, and a tension under which the test piece has the initial length when the test piece is cooled to 25° C. after being heated to 455° C. with the initial length maintained and held for 15 minutes at 455° C. under a load of 100 $N/mm^2$ is defined as a recovered tension. Then, the low-carbon steel sheet is provided with a resist pattern for forming apertures and subjected to etching to form apertures in the low-carbon steel sheet.

In the stretched mask, the low-carbon steel sheet preferably contains, on a weight basis, not more than 0.03% of C, not more than 0.10% of Si, 0.10% to 0.60% of Mn, not more than 0.10% of P, not more than 0.10% of S, 70 ppm to 170 ppm of N, and incidental impurities as components other than iron.

In the stretched mask, the low-carbon steel sheet preferably contains 100 ppm to 170 ppm of nitrogen on a weight basis.

In addition, the present invention provides a material for a stretched mask for a color picture tube. The material is a low-carbon steel sheet containing 70 ppm to 170 ppm of nitrogen on a weight basis. The low-carbon steel sheet is heat-treated at a temperature at which recrystallization does not take place, and has a tension recovery factor of not less than 90%.

In addition, the present invention provides a material for a stretched mask for a color picture tube. The material is a low-carbon steel sheet containing 70 ppm to 170 ppm of nitrogen on a weight basis. The low-carbon steel sheet has a tension recovery factor of not less than 90% after being heat-treated at a temperature at which recrystallization does not take place. The tension recovery factor is expressed as the ratio of a recovered tension to an initial tension. The recovered tension is defined as follows. The length of a test piece when a load of 500 $N/mm^2$ is applied thereto at 25° C. is defined as an initial length, and a tension under which the test piece has the initial length when the test piece is cooled to 25° C. after being heated to 455° C. with the initial length maintained and held for 15 minutes at 455° C. under a load of 100 N/mm$^2$ is defined as a recovered tension.

In the material for a stretched mask, the low-carbon steel sheet preferably contains, on a weight basis, not more than 0.03% of C, not more than 0.10% of Si, 0.10% to 0.60% of Mn, not more than 0.10% of P, not more than 0.10% of S, 70 ppm to 170 ppm of N, and incidental impurities as components other than iron.

In the material for a stretched mask, the low-carbon steel sheet preferably contains 100 ppm to 170 ppm of nitrogen on a-weight basis.

DESCRIPTION OF THE PREFERRED EMBODIMENTS

According to the present invention, a low-carbon steel sheet having a specific value for the nitrogen content in particular is heated to a temperature at which recrystallization does not take place, thereby obtaining a stretched color discrimination mask that has a high recovery factor and is free from problems such as breakage when stretched and twist of the tape.

A low-carbon steel sheet suitably used for the stretched color discrimination mask according to the present invention contains not more than 0.03% (per cent by weight; the same shall apply hereinafter) of C, not more than 0.10% of Si, 0.10% to 0.60% of Mn, not more than 0.10% of P, not more than 0.10% of S, and the balance Fe and incidental impurities. In the low-carbon steel sheet used in the present invention, C forms carbide. If the C content increases, the ability of the-low-carbon steel sheet to be etched in the color selection electrode producing process is impaired. Therefore, the C content is preferably not more than 0.03%.

Si forms silicate inclusions such as MnO—$SiO_2$ and MnO—FeO—$SiO_2$ and consequently impairs the etching properties. Therefore, the Si content is preferably not more than 0.10%. The Mn content is preferably in the range of from 0.10% to 0.60% from the viewpoint of the deoxidizing action and hot shortness prevention in the steel making process.

If the P content increases, the steel hardens, and the rollability of the steel degrades. Therefore, the P content is preferably not more than 0.10%.

S forms sulfide inclusions and consequently impairs the etching properties. Therefore, the S content is preferably not more than 0.10%.

The low-carbon steel used in the present invention preferably contains 70 ppm to 170 ppm of nitrogen by weight ratio, even more desirably 100 ppm to 170 ppm, still more desirably 100 ppm to 150 ppm. If the nitrogen content is less than 70 ppm, the strength reduces. If the nitrogen content is more than 170 ppm, grain boundaries grow larger, which is unfavorable from the viewpoint of etching properties.

After being rolled, the low-carbon steel used in the present invention is heat-treated under conditions where recrystallization will not take place in a reducing or non-oxidizing atmosphere. Consequently, the tensile strength becomes higher than that of the conventional materials having small residual stresses, and it is possible to obtain favorable high-temperature creep properties. Preferable heat-treating conditions are as follows. The heat-treating temperature is in the range of from 450° C. to 650° C., and the heat-treating time is in the range of from 3 seconds to 120 seconds. A heat-treating temperature higher than 650° C. is not preferable because recrystallization would take place. If the heat-treating temperature is lower than 450° C., no improvement in properties can be obtained by the heat treatment.

The present invention will be described below by way of examples.

EXAMPLE 1

Low-carbon steel materials of 0.1 mm in thickness made of materials A to G, whose chemical compositions are shown in Table 1 below, were treated for 45 seconds at a temperature of 540° C. to 560° C. in a mixed atmosphere of hydrogen and nitrogen in a continuous annealing furnace. The annealed low-carbon steel materials were each coated at both sides thereof with a water-soluble casein resist. After drying, the resists on the two sides of each material were patterned by using a pair of glass dryplates having obverse and reverse patterns drawn thereon, respectively. It should be noted that the resist patterns were formed in two different ways such that the aperture direction of slits formed by etching using one resist pattern was parallel to the rolling direction, and the aperture direction of slits formed by etching using the other resist pattern was perpendicular to the rolling direction.

Next, exposure, hardening and baking processes were carried out. Thereafter, the patterned resist surfaces were sprayed with a ferric chloride solution having a temperature of 60° C. and a specific gravity of 48° Be as an etching liquid by using a spray to perform etching.

After the etching process, rinsing was carried out, and the resist was removed with an alkaline aqueous solution, followed by washing and drying to produce a color discrimination mask.

Each color discrimination mask obtained was evaluated by the following evaluation method. The results of the evaluation are shown in Table 2 below. Regarding the slit direction in Table 2, "parallel" means that the apertures formed by the etching were parallel to the rolling direction of the material, and "perpendicular" means that the apertures were perpendicular to the rolling direction. The transmittance is the ratio (expressed as percent) of the aperture area to the area of a region lying between the apertures at both ends.

TABLE 1

| | C | Si | Mn | F | S | N | Balance |
|---|---|---|---|---|---|---|---|
| Material A | 0.007 | 0.01 | 0.45 | 0.016 | 0.007 | 0.0080 | Fe and incidental impurities |
| Material B | 0.006 | 0.01 | 0.43 | 0.014 | 0.007 | 0.0100 | Fe and incidental impurities |
| Material C | 0.007 | 0.01 | 0.46 | 0.013 | 0.006 | 0.0122 | Fe and incidental impurities |
| Material D | 0.007 | 0.01 | 0.44 | 0.016 | 0.008 | 0.0140 | Fe and incidental impurities |
| Material E | 0.006 | 0.01 | 0.43 | 0.016 | 0.008 | 0.0150 | Fe and incidental impurities |
| Material F | 0.008 | 0.01 | 0.45 | 0.015 | 0.007 | 0.0163 | Fe and incidental impurities |
| Material G | 0.008 | 0.01 | 0.42 | 0.013 | 0.009 | 0.0170 | Fe and incidental impurities |

(Evaluation Method)

1. Tape Twist

After each color discrimination mask had been stretched under a load of 30 N/mm$^2$, the presence or absence of tape twist was visually checked.

2. Tensile Strength

Tensile strength was measured according to JIS Z2241 by using test piece No. 5 according to JIS Z2201.

3. Tension Recovery Evaluation Method

Two different types of test pieces of 510 mm in length and 25 mm in width were prepared. One type of test piece was formed so that the longitudinal direction thereof was parallel to the material rolling direction. The longitudinal direction of the other type of test piece was perpendicular to the material rolling direction.

Each test piece was held by the holding portions of a tensile testing machine and stretched in the longitudinal direction at 25° C. under an initial load of 500 N/mm$^2$. The distance between the holding portions at this time was measured as an initial length of the test piece.

With the distance between the holding portions maintained at the initial length, the test piece between the holding portions was heated to 455° C. at a heating rate of 1° C./minute in a heating oven with an air atmosphere. The test piece was held for 15 minutes at 455° C. under a load of 100 N/mm$^2$.

Next, cooling was started. With the distance between the holding portions set at the initial length, the load in the longitudinal direction of the test piece at 25° C. was measured as a recovered tension, and the tension recovery factor was obtained by $$\text{Tension recovery factor (\%)} = (\text{recovered tension}/\text{initial tension}) \times 100$$

Comparative Example 1

A low-carbon steel material of 0.1 mm in thickness having a composition consisting essentially of, by weight ratio, 0.006% of C, 0.01% of Si, 0.44% of Mn, 0.010% of P, 0.008% of S, 0.0060% of N, and the balance Fe and incidental impurities was treated for 45 seconds at a temperature of 540° C. to 560° C. in a mixed atmosphere of hydrogen and nitrogen in a heating oven. The annealed material was etched in the same way as in Example 1 to produce a color discrimination mask. The color discrimination mask was evaluated in the same way as in Example 1. The results of the evaluation are shown in Table 2.

Comparative Example 2

A color discrimination mask was produced in the same way as in Comparative Example 1 except that annealing process was not carried out. The color discrimination mask was evaluated in the same way as in Example 1. The results of the evaluation are shown in Table 2.

Comparative Example 3

A color discrimination mask was produced in the same way as in Comparative Example 1 by using the material B in Example 1 except that the material B was not annealed. The color discrimination mask was evaluated in the same way as in Example 1. The results of the evaluation are shown in Table 2.

Comparative Example 4

A low-carbon steel material of 0.1 mm in thickness having a composition consisting essentially of, by weight ratio, 0.007% of C, 0.01% of Si, 0.45% of Mn, 0.015% of P, 0.008% of S, 0.0200% of N, and the balance Fe and incidental impurities was treated for 45 seconds at a temperature of 540° C. to 560° C. in a mixed atmosphere of hydrogen and nitrogen in a heating oven. The annealed material was etched in the same way as in Example 1 to produce a color discrimination mask. The color discrimination mask was evaluated in the same way as in Example 1. The results of the evaluation are shown in Table 2.

In Comparative Example 4, it was impossible to perform uniform etching. It is deemed that because uniform etching could not be performed, the linearity of the tape was insufficient, and the tape was twisted.

TABLE 2

| | Annealing | Slit direction | Transmittance (%) | Tape twist | Tension recovery factor (%) |
|---|---|---|---|---|---|
| Example 1 | | | | | |
| Material A | done | parallel | 22.5 | none | 90 |
| | done | perpendicular | 22.6 | none | 92 |
| Material B | done | parallel | 22.6 | none | 95 |
| | done | perpendicular | 22.5 | none | 95 |
| Material C | done | parallel | 22.5 | none | 96 |
| | done | perpendicular | 22.4 | none | 96 |
| Material D | done | parallel | 22.5 | none | 96 |
| | done | perpendicular | 22.4 | none | 96 |
| Material E | done | parallel | 22.5 | none | 97 |
| | done | perpendicular | 22.6 | none | 97 |
| Material F | done | parallel | 22.5 | none | 97 |
| | done | perpendicular | 22.4 | none | 97 |
| Material G | done | parallel | 22.6 | none | 97 |
| | done | perpendicular | 22.4 | none | 97 |
| Comp. Ex. 1 | done | parallel | 22.5 | none | 86 |
| | done | perpendicular | 22.4 | none | 89 |
| Comp. Ex. 2 | undone | parallel | 22.6 | twisted | 84 |
| | undone | perpendicular | 22.6 | twisted | 87 |
| Comp. Ex. 3 | undone | parallel | 22.6 | twisted | 88 |
| | undone | perpendicular | 22.5 | twisted | 89 |
| Comp. Ex. 4 | done | parallel | 20.1 | twisted | 88 |
| | done | perpendicular | 20.2 | twisted | 89 |

As has been described above, the stretched mask for a color picture tube according to the present invention exhibits favorable high-temperature creep properties and is free from problems such as breakage when stretched and tape twist in contrast to the conventional stretched masks using a low-carbon steel sheet as a raw material. Therefore, it is possible to obtain a color picture tube of high quality.

What we claim is:

1. A stretched mask for a color picture tube, which is stretched on a frame, said stretched mask comprising:

a low-carbon steel sheet containing, on a weight basis, not more than 0.03% of C, not more than 0.10% of Si, 0.10% to 0.60% of Mn, not more than 0.10% of P, not more than 0.10% of S, 100 ppm to 170 ppm of N, and incidental impurities as components other than iron, said low-carbon steel sheet being heat-treated at a temperature at which recrystallization does not take place, before said low-carbon steel sheet is provided with a resist pattern for forming apertures and subjected to etching to form apertures in said low-carbon steel sheet.

2. A stretched mask for a color picture tube, which is stretched on a frame, said stretched mask comprising:

a low-carbon steel sheet containing, on a weight basis, not more than 0.03% of C, not more than 0.10% of Si, 0.10% to 0.60% of Mn, not more than 0.10% of P, not more than 0.10% of S, 100 ppm to 170 ppm of N, and incidental impurities as components other than iron, said low-carbon steel sheet having a tension recovery factor of not less than 90% after being heat-treated at a temperature at which recrystallization does not take place, said tension recovery factor being expressed as a ratio of a recovered tension to an initial tension, said recovered tension being defined such that a length of a test piece when a load of 500 $N/mm^2$ is applied thereto at 25° C. is defined as an initial length, and a tension under which the test piece has the initial length when the test piece is cooled to 25° C. after being heated to 455° C. with the initial length maintained and held for 15 minutes at 455° C. under a load of 100 $N/mm^2$ is defined as a recovered tension, said low-carbon steel sheet then being provided with a resist pattern for forming apertures and subjected to etching to form apertures in said low-carbon steel sheet.

* * * * *